US005911283A

United States Patent [19]

Cousins et al.

[11] Patent Number: 5,911,283

[45] Date of Patent: Jun. 15, 1999

[54] SECTIONAL DRIVE SYSTEM

[75] Inventors: James E. Cousins; Ruben C. Boyter, both of Shreveport, La.

[73] Assignee: Perf Drill, Inc., Shreveport, La.

[21] Appl. No.: 08/940,839

[22] Filed: Sep. 30, 1997

Related U.S. Application Data

[63] Continuation-in-part of application No. 08/644,372, May 10, 1996, Pat. No. 5,699,866.

[51] Int. Cl.[6] ..... E21B 7/08

[52] U.S. Cl. ..... 175/78; 175/79

[58] Field of Search ..... 175/61, 62, 52, 175/75, 77, 78, 79

[56] References Cited

U.S. PATENT DOCUMENTS

| | | | |
|---|---|---|---|
| 1,367,042 | 2/1921 | Granville . | |
| 2,516,421 | 7/1950 | Robertson | 255/1.6 |
| 2,539,047 | 1/1951 | Arutunoff | 255/1.6 |
| 2,726,847 | 12/1955 | McCune | 255/1.6 |
| 2,778,603 | 1/1957 | McCune | 255/1.6 |
| 3,667,556 | 6/1972 | Henderson | 175/73 |
| 3,903,974 | 9/1975 | Cullen | 175/17 |
| 3,958,649 | 5/1976 | Bull et al. | 175/61 |
| 4,051,908 | 10/1977 | Driver | 175/78 |
| 4,185,705 | 1/1980 | Bullard | 175/78 |
| 4,368,786 | 1/1983 | Cousins | 175/78 |
| 4,442,908 | 4/1984 | Steenbuck | 175/74 |
| 4,601,353 | 7/1986 | Schu et al. | 175/41 |
| 4,625,815 | 12/1986 | Spies | 175/73 |
| 4,658,916 | 4/1987 | Bond | 175/81 |
| 4,699,224 | 10/1987 | Burton | 175/61 |
| 4,880,067 | 11/1989 | Jelsma | 175/107 |
| 5,337,839 | 8/1994 | Warren | 175/62 |
| 5,373,906 | 12/1994 | Braddick | 175/67 |
| 5,392,858 | 2/1995 | Peters et al. | 166/298 |
| 5,413,184 | 5/1995 | Landers | 175/62 |

*Primary Examiner*—Frank Tsay
*Attorney, Agent, or Firm*—John M Harrison

[57] ABSTRACT

A sectional drive system for transmitting power linearly or in a curved path to an output, which system includes multiple, tapered and splined, interlocking drive segments which are nested and stacked as a segment string that is rotatable in a selected path. The top one of the segments cooperates with a drive mechanism to effect rotation of the nested segments in concert and the bottom one of the segments connects to a suitable output such as a drill bit. Articulation of the segments with respect to each other due to matching asymmetrical splines and companion spline slots having drive faces and spline support faces of dissimilar size, facilitates dampening of drive vibration and bending of the segment string in or out of the chosen path in any desired direction to facilitate transmitting power in a curved path of desired magnitude from the drive mechanism to the output. The segments are typically connected internally by means of a cable or shaft or externally by "floating" collars to facilitate articulation as a segment string.

28 Claims, 4 Drawing Sheets

SECTIONAL DRIVE SYSTEM

CROSS-REFERENCE TO RELATED APPLICATIONS

This application is a continuation-in-part of my U.S. patent application Ser. No. 08/644,372, Filed May 10, 1996, now U.S. Pat. No. 5,699,866.

BACKGROUND OF THE INVENTION

1. Field of the Invention

This invention relates to drive systems for transmitting power to an output and more particularly, to a sectional drive system which is characterized by multiple, tapered and splined, interlocking and articulating drive segments that are characterized by exterior splines extending from a base and having specially designed drive faces, spline support faces having a larger surface area than the drive faces and matching interior spline slots located in the base. The drive segments are nested and stacked and rotate in concert as a segment string in a selected path. The path may be straight or curved, and in the latter case, the interlocking drive segments articulate to dampen drive vibration, define the chosen curve and facilitate transmission of power from a drive mechanism to an output device. The nested, stacked and articulated segment string can be interconnected interiorly by means of a cable or rod or exteriorly by floating collars and can therefore be used as a drive train in any application where transfer of power and torque are required in a straight line or at substantially any selected angle or deviation from the straight line. The sectional drive system may, for example, be used to effect horizontal drilling or coring of producing hydrocarbon intervals in oil and gas wells, utilizing the multiple, stacked and tapered, interlocking drive segments driven by a downhole drilling motor at one end of the segment string to operate a bit connected to the opposite end of the segment string. Retrieval of the segment string from the interval may typically be facilitated by a cable extending through openings in the drive segments. Consequently, the sectional drive system of this invention can be used in a downhole drilling apparatus to more efficiently effect drilling deviation in a controlled manner from a vertical or horizontal well bore and provide a primary horizontal deviation or a lateral deviation from an existing horizontal well bore.

While capable of being operated in an extremely efficient manner to permit horizontal or angular drilling of drain hole perforations in oil wells, the sectional drive system of this invention can also be implemented to transmit power from substantially any drive system to an output apparatus, drive or other system under circumstances where the power is to be transmitted in an offset or a curved line. Accordingly, the sectional drive system of this invention may be designed with extended taper or truncated thick base segments and used to transmit power from an engine, motor or other power source to automobiles, mud motors and like apparatus and equipment, as well as dental drills, robotic devices and material handling equipment, in non-exclusive particular.

2. Description of the Prior Art

Conventional techniques for effecting the transmission of power between a power source and an output under circumstances where the power is to be transmitted in an offset or curved manner, includes use of the mechanical devices as coupling mechanisms such as a universal or "CV" joint, which coupling mechanisms are well known to those skilled in the art. For example, many devices have been designed for lowering into an oil or gas well for the purpose of boring and drilling holes at right angles to the well bore at the production interval, but many problems have been encountered in using these systems. Typically, the relatively low bit rotational speed generally necessitated by using curved shafts of various design sometimes requires excessive time to achieve significant penetration, and increasing the bit rotational speed and torque load frequently causes failure of the shafts. Accordingly, these conventional horizontal drilling devices have not proved capable of sustaining the high compressive loads necessary to penetrate the well casing, concrete sheath, rock and producing interval in a well within an economical time frame without failure. Other problems have been encountered, such as bit retrieval and reduced freedom of rotation of the drilling string in such applications.

Among the directional drilling apparatus designed to achieve this function are those detailed in the following U.S. patents: U.S. Pat. No. 1,367,042, to Granville; U.S. Pat. No. 2,516,421, to Robertson; U.S. Pat. No. 2,539,047, to Arutunoff; U.S. Pat. No. 2,726,847, to McCune; U.S. Pat. No. 2,778,603, to McCune; U.S. Pat. No. 3,667,556, to Henderson; U.S. Pat. No. 3,903,974, to Cullen; U.S. Pat. No. 3,958,649, to Bull et al; U.S. Pat. No. 4,051,908, to Driver; U.S. Pat. No. 4,185,705, to Bullard; U.S. Pat. No. 4,368,986, to Cousins; U.S. Pat. No. 4,442,908, to Steenbock; U.S. Pat. No. 4,601,353, to Schuh et al; U.S. Pat. No. 4,625,815, to Spies; U.S. Pat. No. 4,658,916, to Bond; U.S. Pat. No. 4,699,224 to Burton; U.S. Pat. No. 4,880,067, to Felsma; U.S. Pat. No. 5,337,839, to Warren et al; U.S. Pat. No. 5,373,906, to Braddick; U.S. Pat. No. 5,392,858, to Peters et al; and U.S. Pat. No. 5,413,184, to Landers.

It is an object of this invention to provide an articulated sectional drive system for transmitting power linearly or in a deviated, curved or offset path to an output of selected character.

Another object of this invention is to provide a sectional drive system for transmitting power linearly or in a curved path or offset from a source of power to an output, which sectional drive system includes multiple, tapered and splined interlocking thick base drive segments that have asymmetrical splines and are stacked and nested and rotate as a segment string responsive to application of power to one end of the segment string to operate the output at the opposite end.

A still further object of this invention is to provide a sectional drive system of selected length and size, which drive system includes multiple, tapered and splined interlocking thick base drive segments that extend to a full or extended taper or are truncated at the spline taper and include a base having protruding splines with drive faces and spline support faces of unequal size, as well as spline slots or seats in the base for receiving the projecting splines. The drive segments are rotatably stacked and nested and articulate as a segment string within or without a guide path such as a tube, with the segments typically interconnected by a cable, rod or "floating" collar, for dampening drive mechanism vibration and transmitting power between a drive system and an output.

Yet another object of this invention is to provide a sectional drive system having drive segments with asymmetrical splines for drilling one or more drain holes of selected depth and angle into a producing interval of an oil or gas well to increase the flow of hydrocarbons or gas from the interval into the well bore.

A still further object of this invention is to provide a self-contained sectional drive system characterized by multiple, tapered, splined and interlocking extended taper and truncated taper drive segments that may be rotatably stacked, nested and articulated, optionally on a cable, shaft or rod as a segment string, or fitted with locking grooves and cooperating external floating collars, in a straight or curved guide path. One end of the segment string is connected to a drive apparatus such as a mud motor and the opposite end to an output such as a drill bit. The segment string may be typically rotated by the mud motor to drill a hole through well casing, concrete, damaged formations and into undamaged production formation and increase the flow of hydrocarbons into the well bore of an oil or gas well.

Still another object of the invention is to provide a transverse down-hole drilling system which is self-contained and includes multiple, cable-mounted, tapered, splined, interlocking extended-taper drive segments. The drive segments have a round base and drive faces and spline support faces of unequal area projecting from the base and companion spline slots in the base. The segments nest and rotate in concert as a segment or drive string and articulate with respect to each other in a curved path or a groove or tube. The curved path may be shaped in such a manner as to permit sufficient lateral movement to traverse a path bend at any predetermined angle with an output such as a drill bit attached to the lower end of the string and an input such as a down-hole electric or hydraulic drilling motor coupled to the upper end of the segment string for effecting rotation of the driving string and drill bit. The segments may be interconnected by means of an internal cable, a rod or shaft or multiple internally-flanged "floating" collars to define the drive string.

SUMMARY OF THE INVENTION

These and other objects of the invention are provided in a new and improved sectional drive system for transmitting power from a drive source or apparatus of selected character to an output device of selected design, especially under circumstances where the drive apparatus and the output device are misaligned. The sectional drive system is characterized by multiple, tapered and splined, interlocking, extended taper and truncated taper thick base drive segments which typically include eight spaced, a asymmetrical splines extending from a round base and having angular drive faces and spline support faces of unequal area and eight asymmetrical spline slots shaped in the base and offset rotationally from the splines, for receiving the splines in driving relationship. The drive segments may be optionally slidably mounted on a cable or rod or externally connected by internally flanged floating collars mounted in corresponding locking grooves in the segments and stacked and nested as a rotatable, articulating segment string, one end of which string is attached to the drive mechanism and the opposite end to the output device.

BRIEF DESCRIPTION OF THE DRAWINGS

The invention will be better understood by reference to the accompanying drawings, wherein.

DESCRIPTION OF THE PREFERRED EMBODIMENTS

Figure 1:
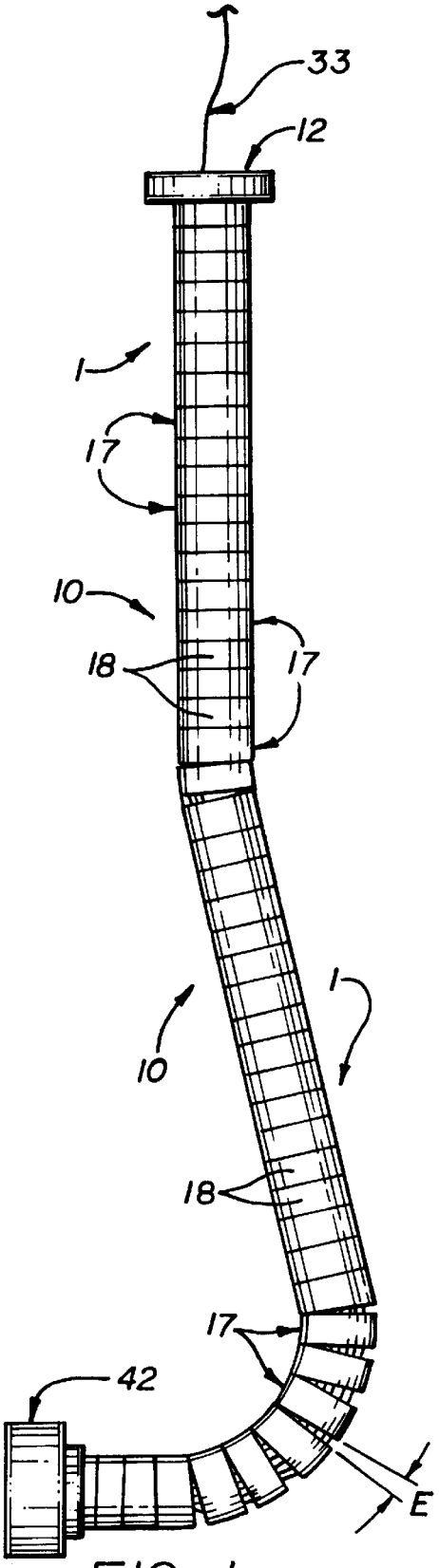
FIG. 1 is a side view of a typical sectional drive system of this invention, driven at one end by a suitable drive apparatus for rotating an output device on the opposite end, with the drive segments connected by a cable.
Figure 2:
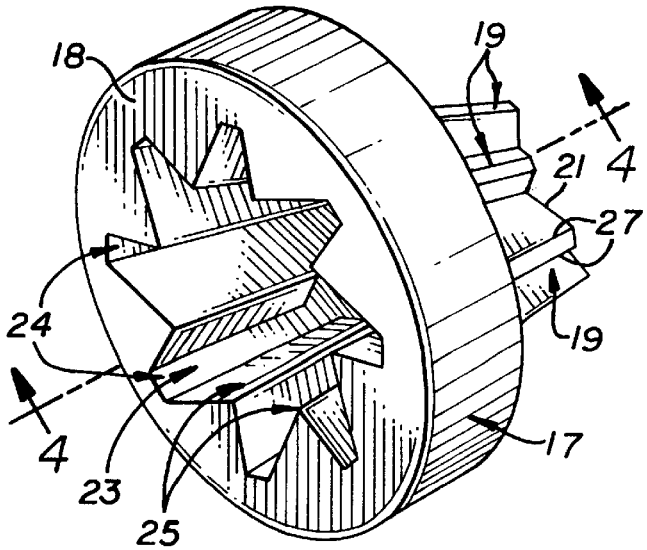
FIG. 2 is a perspective view of a typical extended taper, thick base drive segment element in the sectional drive system illustrated in FIG. 1.
Figure 3:
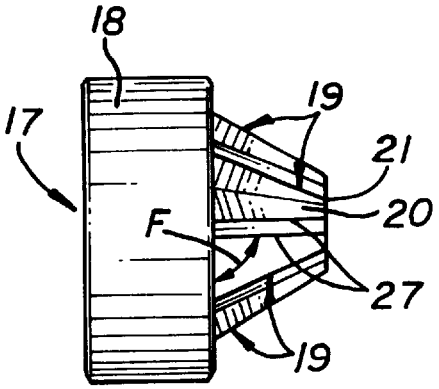
FIG. 3 is a side view of the extended taper, thick base drive segment element illustrated in FIG. 2.
Figure 4:
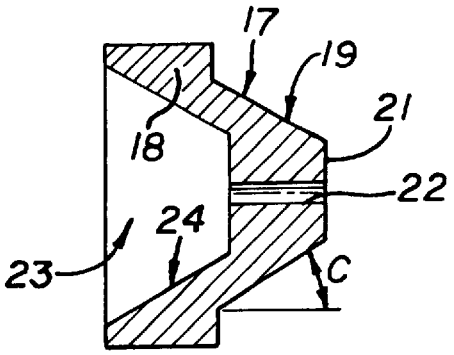
FIG. 4 is a sectional view taken along line 4—4 of the extended taper, thick base drive segment illustrated in FIG. 2.
Figure 5:
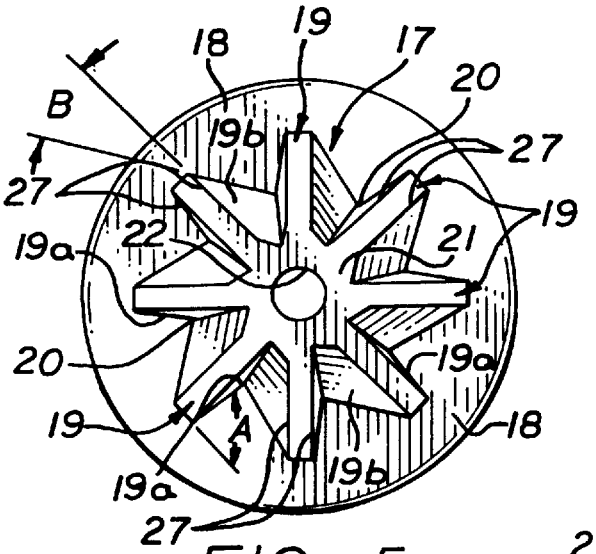
FIG. 5 is a front view of the extended taper, thick base drive segment illustrated in FIG. 2, more particularly illustrating the exterior splines and exterior spline slots.
Figure 6:
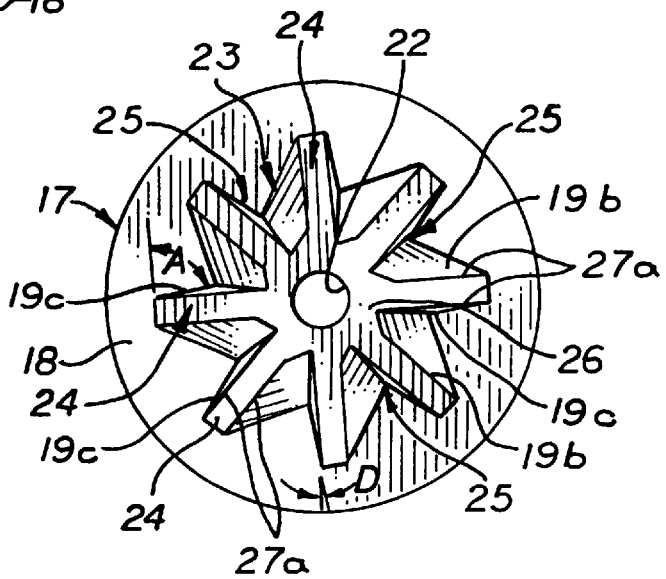
FIG. 6 is a rear view of the extended taper, thick base drive segment illustrated in FIG. 2, more particularly illustrating the interior splines and interior spline slots extending from a round base.
Figure 7:
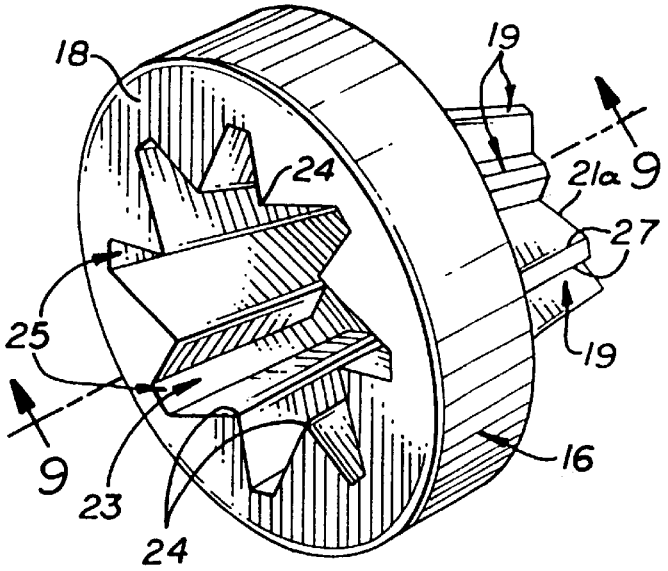
FIG. 7 is a perspective view of a typical truncated taper thick base drive segment element in the sectional drive system illustrated in FIG. 1A.
Figure 8:
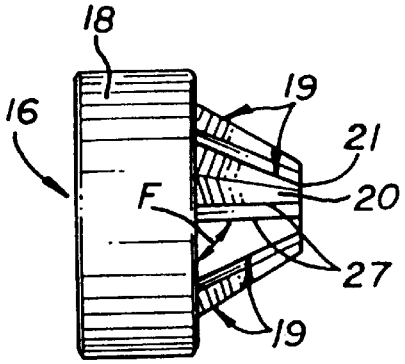
FIG. 8 is a side view of the truncated taper thick base drive segment illustrated in FIG. 7.
Figure 9:
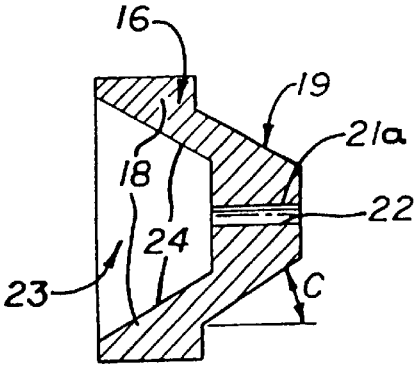
FIG. 9 is a sectional view taken along line 9—9 of the truncated taper thick base drive segment illustrated in FIG. 7.
Figure 10:
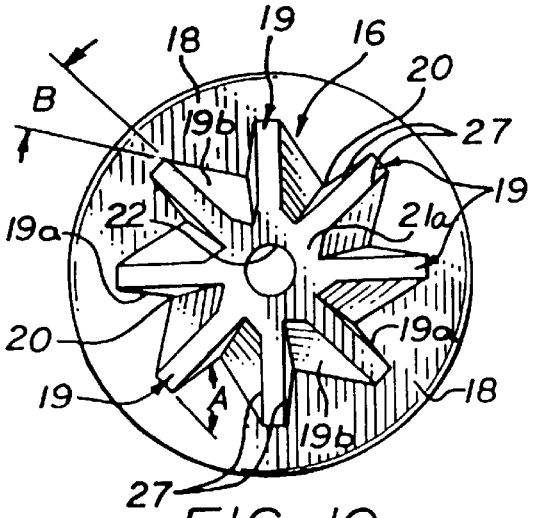
FIG. 10 is a front view of the truncated taper thick base drive segment illustrated in FIG. 7, more particularly illustrating the exterior splines and exterior spline slots.
Figure 11:
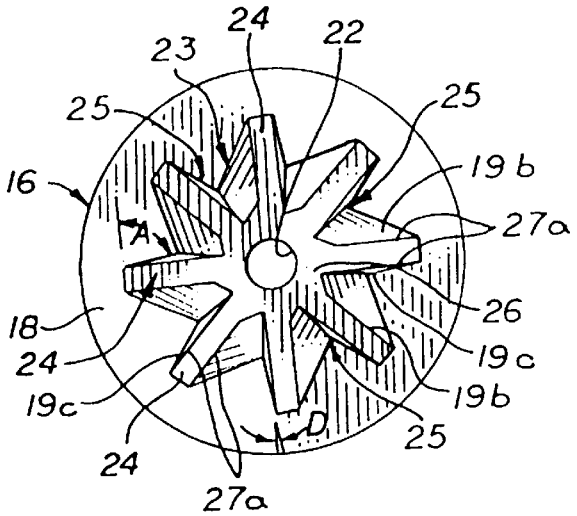
FIG. 11 is a rear view of the truncated taper thick base drive segment illustrated in FIG. 7, more particularly illustrating the interior splines and interior spline slots.

Referring now to FIGS. 1–6 of the drawings, the sectional drive system of this invention is generally illustrated by reference numeral 1. The sectional drive system 1 is characterized by a drive string 10 formed by stacking multiple, extended taper thick base drive segments 17 (hereinafter called drive segments 17), on a segment cable 33, each of which extended taper drive segments 17 includes a flat, round, thick segment base 18 and longitudinally tapering, asymmetrical exterior splines 19, recessed inwardly from the perimeter of the segment base 18, as illustrated in FIGS. 3–6. In a preferred embodiment of the invention each of the extended taper drive segments 17 is shaped to include eight exterior splines 19, each having an angular drive face 19*a* and each of which taper in a direction transverse to the longitudinal axis of the exterior splines 19 to define eight exterior spline slots 20 in a repetitive, geometric pattern which resembles an eight point star when viewed from the front or rear, as illustrated in FIGS. 5 and 6. As further illustrated in FIG. 5, the taper of the drive and spline support faces 19*a* and 19*b*, respectively, of the exterior splines 19 is uneven or asymmetrical, with the right-hand clockwise taper across the respective angular drive faces 19*a* being more steep than the taper in the opposite spline support faces 19*b*. In a most preferred embodiment, the bottom edge of each spline support face 19*b* extends along the top surface of the segment base 18 at an angle "B" of from about 10 degrees to about 45 degrees with respect to the external spline edge 27 of the corresponding exterior spline 19 lying adjacent to the spline support faces 19*b*, for optimum spline strength. The spline support faces 19*b* taper to a flat tip 21, which is coplanar with the converging sets of parallel external spline edges 27, and a tip aperture 22 may be provided in the center of the tip 21 and extends through the tip 21 into the hollow segment interior 23 of each of the extended taper drive segments 17, as illustrated in FIGS. 2 and 4. As further illustrated in FIG. 5, the horizontal angle "A" defined by the base edge of the angular drive face 19*a* and the adjacent external spline of each asymmetrical exterior spline 19 is preferably in the range of from about 60 degrees to about 90 degrees and most preferably, about 85 degrees, for optimum driving characteristics. Moreover, referring to FIG. 3 of the drawings, the vertical drive face angle LF, measured between the plane of the segment base 18 and the drive face 19*a*, is preferably in the range of from about 80 degrees to about 120 degrees and most preferably, about 93 degrees.

Referring again to FIGS. 2, 3 and 6, the segment interior 23 of each of the extended taper drive segments 17 includes multiple, spaced, interior spline seats 24, having internal spline edges 27*a*, which project into the segment interior 23 shaped in the segment base 18 and correspond to the correspondingly-shaped exterior splines 19, respectively. The interior spline seats 24 extend from the surface of the segment base 18 to the flat tip seat 26, which is spaced from the tip 21 on the exterior splines 19, illustrated in FIG. 5. The interior spline seats 24 are also tapered transversely to the longitudinal axis of the interior spline seats 24 to define the interior splines 25, the latter of which correspond in shape to the exterior spline slots 20, respectively. As described above, a second horizontal angle "A" is defined by the base edge of the angular driven face 19*c* and the adjacent internal spline edge 27*a* of an interior spline seat 24 and is preferably in the range of from about 60 to about 90 degrees, and most preferably, about 85 degrees. Accordingly, the extended taper drive segments 17 will nest, stack and interlock and yet articulate transversely with respect to each other in driving relationship to shape the drive string 10, as illustrated in FIG. 1, with the exterior splines 19 of one segment registering with the interior spline seats 24 of an adjacent segment. This interlocking registration is not rigid, but permits lateral, or transverse movement of the extended taper drive segments 17 in the interlocking and nested configuration, such that the extended taper drive segments 17 can easily bend and articulate to conform to the bend illustrated in FIG. 1, and yet maintain an interlocking, driving relationship of high integrity due to the matched drive faces 19*a* and driven faces 19*c*, which articulation also serves to dampen any misalignment between the input 12 and output 42, illustrated in FIG. 1.

Referring again to FIGS. 5 and 6, the extended taper drive segments 17 are designed such that the internal spline seats 24 in the segment base 18 are rotatably offset with respect to the exterior splines 19. This offset is preferably at a rotational angle "D", illustrated in FIG. 6, in the range of from about 0.50 degrees to about 12 degrees, and most preferably about 6 degrees. This rotational angle "D" facilitates proper meshing of the exterior splines 19 and interior spline seats 24. Lateral movement of the extended taper drive segments 17 in the registered and stacked configuration facilitates application of torque to the top of the drive string 10 by means of an input 12 of selected design to rotate the drive string 10 and the output 42 attached to the opposite end of the drive string 10, as further illustrated in FIG. 1. Optimum engagement of the respective exterior splines 19 and the interior spline seats 24 is effected by recessing the exterior splines 19 inwardly from the periphery of the segment base 18 to facilitate complete nesting and stacking of the extended taper drive segments 17, as illustrated in FIG. 1.

In another most preferred embodiment of the invention the angle "C" of taper of the interior spline seats 24 and the asymmetrical exterior splines 19 from the segment base 18 to the truncated tip 21*a* and the tip 21, respectively, defined as the spline support face 19*b*, is in the range of from about 10 degrees to about 80 degrees and most preferably, about 30 degrees, when one of the extended taper drive segments 17 is viewed as illustrated in FIG. 4. This structuring of the extended taper drive segments 17 facilitates a drive string 10 which is capable of bending or articulating with a separation angle "E", illustrated in FIG. 1, of from about 0 to approximately 10 degrees for each one of the extended taper drive segments 17 utilized in the drive string 10, to facilitate traversal of the bend illustrated in FIG. 1 and yet maintain optimum interlocking contact between the angular drive faces 19*a* and driven faces 19*c* to effect driving rotation of the selected output 42 responsive to power applied to the drive string 10 by the selected input 12.

Figure 1A:
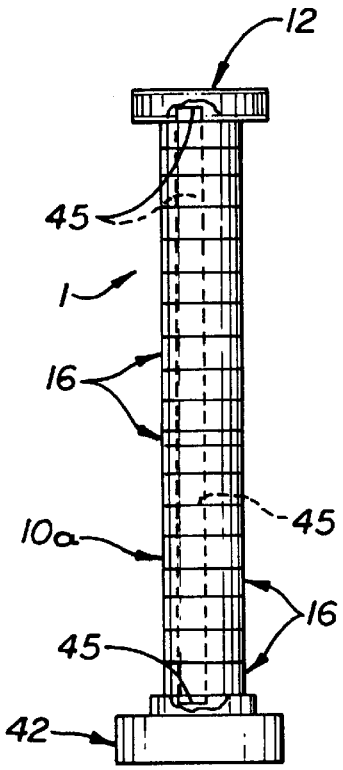
FIG. 1A is a side view of a typical sectional drive system with the drive segments connected by a rod or shaft.

Referring now to FIGS. 1A and 7–11 of the drawings, the drive string 10*a* illustrated in FIG. 1A may be constructed or shaped from truncated taper thick base drive segments 16 (hereinafter called truncated taper drive segments 16), which are generally shaped as the extended taper drive segments 17, but are shorter, with a larger truncated tip 21*a*. As illustrated in FIGS. 1A, 9, 10 and 11, the truncated taper drive segments 16 are typically fitted with a tip aperture 22 and may be connected by means of a fixed or "floating" shaft 45, which extends through the respective, substantially aligned tip apertures 22 in the respective truncated taper drive segments 16.

Referring again to FIG. 1A of the drawings, in a preferred embodiment of the invention a set of extended taper drive segments 17 (or truncated taper drive segments 16) may be slidably strung on a stiff or flexible shaft or cable 45, one end of which may be fitted with a cable stay or anchor (not illustrated) or otherwise fixed inside the output 42 and the other end threaded through the tip aperture 22 of the last one of the extended taper drive segments 17 (or truncated taper drive segments 16) and the drive string 10*a* and then through the tip aperture 22 of each of the nested extended taper drive segments 17 (or the truncated drive segments 16) for similar attachment to the input 12, to maintain the segments in place. When the output 42 is configured as a drill bit, one or more drain holes (not illustrated) can be drilled according to the procedure outlined in our copending U.S. patent application and the drive string 10 can be retrieved from the drain hole by application of the segment cable 33, illustrated in FIG. 1. In a most preferred embodiment of the invention the segment bit may be typically about 20% larger than the extended taper drive segments 17 or truncated taper drive segments 16 to better facilitate retrieval of the drive string 10 and to facilitate the removal of debris from the drain hole as the drive string 10 and the segment bit are removed from the drain hole. It will be appreciated that no such segment cable 33 is necessary under circumstances where the drive string 10 is to be left in the drain hole and not retrieved.

As illustrated in FIG. 1A, either the extended taper drive segments 17 or the truncated drive segments 16 may be slidably assembled on a "floating" rod or shaft 45, to maintain the segments in articulating contact, regardless of orientation while driven by the input 12 and operating the output 42. The shaft 45 typically "floats" in the respective segments and may or may be attached to the input 12 or output 42, to achieve this end.

Figure 12:
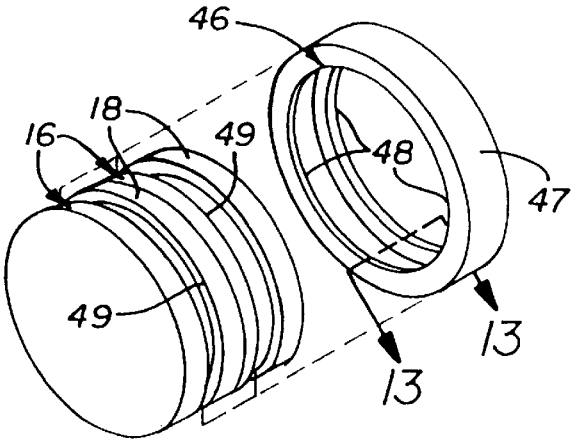
FIG. 12 is a perspective, exploded view of a typical pair of thick base drive segments and a "floating" collar for connecting the drive segments.
Figure 13:
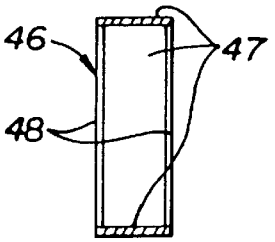
FIG. 13 is a sectional view of the internally flanged floating collar, taken along line 13—13 in FIG. 12.
Figure 14:
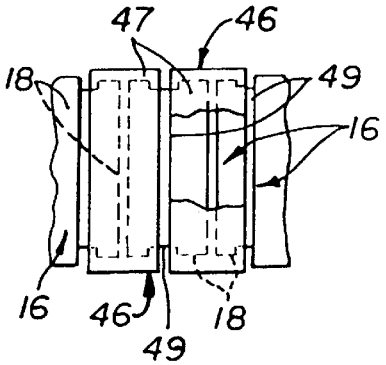
FIG. 14 is a side view, partially in section, of the floating collar assembled on the pair of thick base drive segments illustrated in FIG. 12.

Referring now to FIGS. 12–14 of the drawings, in a still further alternative embodiment of the invention, the extended taper drive segments 17 or truncated taper drive segments 16, whether provided with a tip aperture 22 or not, can be assembled in articulating configuration using multiple "floating" collars 46. The collars 46 are each characterized by a circular collar ring 47, fitted with inwardly-extending collar flanges 48 on the outside periphery thereof, which collar flanges 48 fit into segment base locking grooves 49, provided in the segment base 18 of each of the extended tapered drive segments 17 or truncated taper drive segments 16. It will be appreciated from a consideration of FIGS. 12 and 14 that the segment base locking groove 49 in each of the segments is sufficiently wide to accommodate a pair of the collar flanges 48 which extend from the collar rings 47 of adjacent floating collars 46. Furthermore, each segment base locking groove 49 is sufficiently wide to facilitate movement of the adjacent collar flange 48 therein to provide for the necessary articulation between successively connected extended taper drive segments 17 or truncated taper drive segments 16. It will therefore be appreciated from a consideration of FIGS. 12–14, that the respective extended taper drive segments 17 or truncated taper drive segments 16 may articulate with respect to each other when connected by the respective floating collars 46 to negotiate various curves, deviations and alignment irregularities between the input 12 and the output 42 illustrated in FIGS. 1 and 1A.

Referring again to FIGS. 1–6 and 7–11 of the drawings, it will be appreciated by those skilled in the art that substantially any number of exterior splines 19, exterior spline slots 20, interior spline seats 24 and interior splines 25 can be provided in the design of the extended taper drive segments 17 and the truncated taper drive segments 16. However, in a most preferred embodiment of the invention eight exterior splines 19, exterior spline slots 20 and matching interior spline seats 24 and interior splines 25 are provided for each one of the extended taper drive segments 17 and the truncated taper drive segments 16 in the drive string 10 and 10*a*, as illustrated. In a most preferred embodiment the eight exterior splines 19 and interior spline seats 24 are equally tapered at the spline support faces 19*b*, as heretofore described and the exterior splines 19 and exterior spline slots 20 are typically about 2% to about 5% smaller than the interior spline seats 24 and the interior splines 25, for optimum smoothness and meshing during separation of the extended taper drive segments 17 and the truncated taper drive segments 16 while operating typically as illustrated in FIG. 1.

It will be further appreciated by those skilled in the art that other applications of the sectional drive system 1 may include the application of torque and thrust in a straight line or along a deviation from the straight line up to or even beyond ninety degrees, wherein the extended taper drive segments 17 and truncated taper drive segments 16 articulate, either on the segment cable 33, the fixed or "floating" shaft 45 or by the interlocking action of the "floating" collars 46, in any desired direction. Torque may also be applied to the segments as the latter lie in a curved tube or path (not illustrated), as desired. Accordingly, typical applications include "CV" joints and mechanical couplings in vehicles, mud motors and other applications involving misaligned drive and driven systems. Application to dental drills may also be effected under circumstances where the dental drill drive train must be curved over a selected adjustable or fixed radius from the drive motor to the application or drill end. The device may also be used in tools such as flexible shaft screw drivers and similar applications, in non-exclusive particular.

It will be appreciated by those skilled in the art that the extended taper drive segments 17 and truncated taper drive segments 16 can be constructed of substantially any desired material, depending upon the application. Furthermore, the extended taper drive segments 17 are typically applied where the deviation, offset or curve between the input 12 and the output 42 is significant. The truncated taper drive segments 16 are normally used in applications where the deviation between the input 12 and output 42 is minimal and considerable torque strength is required in the sectional drive string 10.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A sectional drive system for coupling a drive to an output, comprising at least two segments connected to the drive and the output, said segments comprising a round base; a plurality of exterior splines tapering in spaced relationship with respect to each other from said round base to define substantially parallel exterior spline edges, said exterior spline edges of said exterior splines terminating in a tip and said exterior splines defining multiple exterior drive faces and spline support faces of unequal size; and interior spline seats provided in said base, said interior spline seats having substantially parallel interior spline edges and said interior spline seats disposed in rotationally offset angular relationship with respect to said exterior splines, for receiving said exterior splines of adjacent ones of said segments, whereby said segments are interlocked in stacked relationship to connect the drive to the output.

2. The sectional drive system of claim 1 comprising an opening provided in said segments and connecting means extending through said opening, whereby said segments are mounted in articulating relationship with respect to each other on said connecting means.

3. The sectional drive system of claim 1 wherein said plurality of exterior splines and said interior spline seats comprise eight exterior splines and eight interior spline seats.

4. The sectional drive system of claim 1 comprising an opening provided in said tip of said segments and internal connecting means extending longitudinally through said opening, whereby said segments are mounted in articulating relationship with respect to each other on said internal connecting means.

5. The sectional drive system of claim 1 comprising driven faces defined in said interior spline seats and wherein said drive faces engage said driven faces in driving relationship.

6. The sectional drive system of claim 5 wherein said drive faces are oriented in said exterior splines at a drive face angle in the range of from about 60 degrees to about 90 degrees with respect to said exterior spline edges of said exterior splines and said driven faces are oriented in said interior spline seats at a driven face angle in the range of from about 60 degrees to about 90 degrees with respect to said interior spline edges of said interior splines.

7. The sectional drive system of claim 1 wherein said exterior splines are truncated by a plane extending between said base and said tip.

8. The sectional drive system of claim 1 comprising:

(a) a plurality of drive faces defined in said exterior splines; and (b) a plurality of driven faces defined in said interior spline seats for engaging said drive faces in driven relationship.

9. The sectional drive system of claim 8 wherein said drive faces are oriented in said exterior splines at a drive face angle in the range of from about 60 degrees to about 90 degrees with respect to said exterior spline edges of said exterior splines and said driven faces are oriented in said interior spline seats at a driven face angle in the range of from about 60 degrees to about 90 degrees with respect to said interior spline edges of said interior splines.

10. The sectional drive system of claim 9 wherein said exterior splines are truncated by a plane extending between said base and said tip substantially parallel to the plane of said base.

11. The sectional drive system of claim 9 comprising an opening provided in said tip of said segments and internal connecting means extending longitudinally through said opening, whereby said segments are mounted in articulating relationship with respect to each other on said internal connecting means.

12. The sectional drive system of claim 1 wherein said exterior splines are truncated by a plane extending between said base and said tip substantially parallel to the plane of said base.

13. The sectional drive system of claim 1 comprising groove means provided in said segments and collar means loosely engaging said groove means, whereby said segments are interconnected in articulating relationship with respect to each other.

14. The sectional drive system of claim 13 wherein:

(a) said drive faces are oriented in said exterior splines at a drive face angle in the range of from about 60 degrees to about 90 degrees with respect to said exterior spline edges of said exterior splines; and (b) said driven faces are oriented in said interior splines at a driven face angle in the range of from about 60 degrees to about 90 degrees with respect to said interior spline edges of said interior splines.

15. The sectional drive system of claim 14 wherein said exterior splines are truncated by a plane extending between said base and said tip substantially parallel to the plane of said base.

16. A sectional drive system for coupling a drive to an output, comprising a plurality of driving segments engaging said drive and said output, each of said segments having a circular base and multiple exterior splines tapering in spaced relationship with respect to each other from said circular base to a tip, said exterior splines defining peripheral edges and drive faces, said exterior splines further defining spline walls of unequal size; and multiple interior splines and interior spline seats provided in said base, said interior spline seats disposed at a rotational angle in the range of from about 0.5 degrees to about 12 degrees displaced in said base with respect to said exterior splines, for receiving said exterior splines of adjacent ones of said segments, whereby said segments are interlocked in stacked relationship to connect the drive to the output.

17. The sectional drive system of claim 16 comprising connecting means engaging said segments, whereby said segments are mounted in articulating relationship with respect to each other on said connecting means.

18. The sectional drive system of claim 16 wherein said multiple exterior splines and said multiple interior splines comprise eight exterior splines and eight interior splines.

19. The sectional drive system of claim 16 comprising a plurality of driven faces oriented in said interior spline seats for engaging said drive faces in driven relationship.

20. The sectional drive system of claim 16 comprising an opening provided in said tip and wherein said connecting means comprises a cable extending through said opening, whereby said segments are mounted on said cable in articulating relationship with respect to each other.

21. The sectional drive system of claim 16 wherein said exterior splines are truncated by a plane extending between said base and said tip substantially parallel to the plane of said base.

22. The sectional drive system of claim 17 comprising an opening provided in said tip and wherein:

(a) said multiple exterior splines and said multiple interior splines comprise eight exterior splines and eight interior splines; and (b) said connecting means comprises a cable extending through said opening in said tip, whereby said segments are mounted on said cable in articulating relationship with respect to each other.

23. The sectional drive system of claim 22 comprising a plurality of driven faces oriented in said interior spline seats for engaging said drive faces in driven relationship.

24. The sectional drive system of claim 23 wherein said exterior splines are truncated by a plane extending between said base and said tip substantially parallel to the plane of said base.

25. The sectional drive system of claim 17 wherein said connecting means comprises a rod or shaft extending through said segments into the drive and the output for maintaining said segments between the drive and the output.

26. The sectional drive system of claim 25 comprising a plurality of driven faces oriented in said interior spline seats for engaging said drive faces in driven relationship.

27. The sectional drive system of claim 26 wherein said exterior splines are truncated by a plane extending between said base and said tip substantially parallel to the plane of said base.

28. A sectional drive system for coupling a drive to an output, comprising a plurality of driving segments engaging said drive and said output, each of said segments having a circular base and multiple exterior splines tapering in spaced relationship with respect to each other from said circular base to a tip, said exterior splines truncated between said base and said tip and defining peripheral edges and drive faces, said exterior splines further defining spline walls of unequal size; and multiple interior splines and interior spline seats provided in said base, said interior spline seats defining driven force for engaging said drive forces and said interior spline seats disposed at a rotational angle in the range of from about 0.5 degrees to about 12 degrees displaced in said base with respect to said exterior splines, for receiving said exterior splines of adjacent ones of said segments, whereby said segments are interlocked in stacked relationship to connect the drive to the output.

* * * * *